US010421201B2

(12) United States Patent
Schmidt

(10) Patent No.: US 10,421,201 B2
(45) Date of Patent: Sep. 24, 2019

(54) SAFETY CUTTER APPARATUS AND SYSTEM

(71) Applicant: Pacific Handy Cutter, Inc., Irvine, CA (US)

(72) Inventor: G. Gerry Schmidt, Newport Beach, CA (US)

(73) Assignee: PACIFIC HANDY CUTTER, INC., Irvine, CA (US)

( * ) Notice: Subject to any disclaimer, the term of this patent is extended or adjusted under 35 U.S.C. 154(b) by 0 days.

(21) Appl. No.: 15/277,932

(22) Filed: Sep. 27, 2016

(65) Prior Publication Data

US 2017/0246747 A1 Aug. 31, 2017

Related U.S. Application Data

(60) Division of application No. 14/513,885, filed on Oct. 14, 2014, now Pat. No. 9,452,540, which is a division of application No. 11/556,599, filed on Nov. 3, 2006, now Pat. No. 8,857,064, which is a continuation-in-part of application No. 10/966,733, filed on Oct. 15, 2004, which is a continuation-in-part of application No. 29/247,764, filed on Jul. 10, 2006, now Pat. No. Des. 542,029.

(51) Int. Cl.
*B26B 1/08* (2006.01)
*B26B 5/00* (2006.01)

(52) U.S. Cl.
CPC ..... *B26B 5/003* (2013.01); *B26B 5/001* (2013.01)

(58) Field of Classification Search
CPC .... A45F 5/00; A45F 5/02; A45F 5/021; A45F 2005/026; A45F 2200/0575; B26B 29/025; B26B 5/001; B26B 5/003; B20B 3/06; B25H 3/006
USPC ..... 30/162, 342, 335, 125, 2, 162.2, 164, 30/331, 336, 338, 314, 329, 337, 320, 30/312; 224/660, 232; D8/107, 99, 98, D8/105; 7/118
See application file for complete search history.

(56) References Cited

U.S. PATENT DOCUMENTS 2,862,296 A * 12/1958 Anderson ..... B26B 5/001 30/162
4,805,304 A * 2/1989 Knoop ..... B26B 5/003 30/162
6,154,965 A * 12/2000 Sakai ..... B26B 1/048 30/160
6,273,582 B1 * 8/2001 Taggart ..... B25F 1/003 362/119
6,349,473 B1 * 2/2002 Schmidt ..... B26B 5/001 30/162
6,360,443 B1 * 3/2002 Remus ..... B26B 1/046 30/158
D464,246 S * 10/2002 Sloan ..... D8/99
6,557,262 B1 * 5/2003 Clemence ..... B26B 1/048 30/156

(Continued)

*Primary Examiner* — Ghassem Alie
(74) *Attorney, Agent, or Firm* — Peter L. Holmes

(57) ABSTRACT

A cutter apparatus includes a housing and a blade carrier. The housing is sized to be hand-held and includes a channel and openings adjacent to the channel at three different sides of the housing. The blade carrier is sized to fit within and slide along the channel and includes three engaging portions that extend from the openings such that a force bearing upon any of the portions can cause the blade carrier to slide along the channel.

17 Claims, 13 Drawing Sheets

(56) References Cited

U.S. PATENT DOCUMENTS

| | | | | |
|---|---|---|---|---|
| 6,832,438 | B1 * | 12/2004 | Gringer | B26B 5/003 30/162 |
| 6,907,668 | B2 * | 6/2005 | Polei | B26B 5/003 30/162 |
| 7,316,070 | B2 * | 1/2008 | Green | B26B 5/001 30/162 |
| D581,240 | S * | 11/2008 | Glesser | D8/99 |
| 2003/0196331 | A1 * | 10/2003 | Ho | B26B 5/001 30/162 |

* cited by examiner

SAFETY CUTTER APPARATUS AND SYSTEM

CROSS-REFERENCE TO RELATED APPLICATIONS

This application is a divisional of U.S. patent application Ser. No. 14/513,885 entitled "Safety Cutter Apparatus and System" filed on Oct. 14, 2014 (now U.S. Pat. No. 9,452,540, issued on Sep. 27, 2016), which is a divisional of U.S. patent application Ser. No. 11/556,599 entitled "Safety Cutter Apparatus and System" filed on Nov. 3, 2006 (now U.S. Pat. No. 8,857,064 entitled "Safety Cutter Apparatus", issued on Oct. 14, 2014), which is a continuation-in-part of U.S. patent application Ser. No. 10/966,733 entitled "Safety Cutter with Triple Locking Slider" filed on Oct. 15, 2004, and a continuation-in-part of U.S. patent application Ser. No. 29/247,764 entitled "Holster for Safety Cutter" filed on Jul. 10, 2006 (now U.S. Design Pat. No. D542,029, issued on May 8, 2007), all of which are hereby incorporated by reference.

TECHNICAL FIELD

The invention relates generally to cutters and, in particular, to a safety cutter apparatus and system.

BACKGROUND ART

A variety of cutting devices with retractable blades are known. However, many such devices include cumbersome mechanisms for extending a blade toward and/or retracting a blade from a cutting position. Additionally, cutting devices with retractable blades are often designed such that user intervention is required to retract the blade, thus resulting in a potential safety hazard.

Some cutting devices are designed for use with replaceable blades. The process of blade replacement typically involves disengaging or otherwise separating a blade to be replaced from the cutting device, and engaging or otherwise attaching a replacement blade to the cutting device. Depending upon the complexity of the cutting device and the mechanical aptitude of the user, this process may prove to be challenging.

It is known to provide a cutting device with a holster or other enclosure for holding the cutting device when not in use. Many holsters for cutting devices are designed for right-handed users, e.g., such that the cutting device can be readily withdrawn from a holster at the right side of the user's belt by the right hand and easily transition into an orientation in the right hand that accommodates quick use of the cutting device. Other holsters for cutting devices are designed for left-handed users, e.g., such that the cutting device can be readily withdrawn from a holster at the left side of the user's belt by the left hand and easily transition into an orientation in the left hand that accommodates quick use of the cutting device. Unfortunately, extra engineering effort and manufacturing costs are often associated with having to provide holsters for both left- and right-handed users.

It would be useful to be able to provide a cutter apparatus or system which addresses one or more of the above concerns.

SUMMARY OF THE INVENTION

In an example embodiment, a cutter apparatus includes a housing sized to be hand-held, the housing being made at least in part from a plastic, the housing including a channel and openings adjacent to the channel at three different sides of the housing, and a blade carrier sized to fit within and slide along the channel, the blade carrier including three engaging portions that extend from the openings such that a force bearing upon any of the portions can cause the blade carrier to slide along the channel. In an example embodiment, the plastic includes acrylonitrile butadiene styrene (ABS). In an example embodiment, the blade carrier is configured to secure a blade to the cutter apparatus such that a cutting edge of the blade faces a bottom side of the housing, and the housing includes a metal skid plate which is secured to a bottom side of the housing defining a portion of an opening that faces the blade when the blade carrier is in an extended position. In an example embodiment, the blade carrier is configured to secure a blade to the cutter apparatus such that a cutting edge of the blade faces a bottom side of the housing, and the three engaging portions extend from a top side, a left side, and a right side of the housing. In an example embodiment, the housing and the blade carrier are shaped such that a cutting force applied to the housing when the blade carrier is in an extended position causes a top edge of the blade carrier to come into contact with the housing to frictionally lock the blade carrier in the extended position until the cutting force is removed. In an example embodiment, the housing includes dual flange members which are snap fitted through a channel in the blade carrier. In an example embodiment, the cutter apparatus further includes means for biasing the blade carrier toward a retracted position away from a distal end of the housing. In an example embodiment, the means for biasing includes a spring configured to push the blade carrier toward the retracted position. In an example embodiment, one or more of the engaging portions include a gripping surface. In an example embodiment, the gripping surface includes ridges. In an example embodiment, the housing includes recessed outer surface portions within which the openings are formed. In an example embodiment, the recessed outer surface portions extend longitudinally along the housing. In an example embodiment, one or more of the engaging portions includes a top surface that is substantially flush with an outer surface of the housing adjacent to the recessed outer surface portion. In an example embodiment, the one or more of the engaging portions are two engaging portions that extend from a left side and a right side of the housing, respectively. In an example embodiment, the blade carrier includes blade installation instructions thereon. In an example embodiment, the instructions include an image of a blade shown correctly oriented for installation on the blade carrier. In an example embodiment, the housing includes an indented portion sized to receive spare blades. In an example embodiment, the housing includes two housing portions that are pivotally coupled together. In an example embodiment, the cutter apparatus further includes means for securing the two housing portions together. In an example embodiment, one of the two housing portions includes a threaded channel, and the means for securing includes a screw with a threaded surface complementary to the threaded channel, the screw including a head with a perimeter portion that can be rotated by a user of the cutting apparatus. In an example embodiment, the head is shaped as a wheel. In an example embodiment, the cutter apparatus further includes means for urging the two housing portions apart. In an example embodiment, the means for urging includes a spring.

In an example embodiment, a cutter apparatus includes a housing sized to be hand-held, the housing including a channel and openings adjacent to the channel at three different sides of the housing, the housing includes recessed outer surface portions within which the openings are formed, and a blade carrier sized to fit within and slide along the channel, the blade carrier including three engaging portions that extend from the openings such that a force bearing upon any of the portions can cause the blade carrier to slide along the channel. In an example embodiment, the recessed outer surface portions extend longitudinally along the housing. In an example embodiment, one or more of the engaging portions includes a top surface that is substantially flush with an outer surface of the housing adjacent to the recessed outer surface portion. In an example embodiment, the one or more of the engaging portions are two engaging portions that extend from a left side and a right side of the housing, respectively. In an example embodiment, the housing is made at least in part from a plastic. In an example embodiment, the plastic includes acrylonitrile butadiene styrene (ABS). In an example embodiment, the blade carrier is configured to secure a blade to the cutter apparatus such that a cutting edge of the blade faces a bottom side of the housing, and the housing includes a metal skid plate which is secured to a bottom side of the housing defining a portion of an opening that faces the blade when the blade carrier is in an extended position. In an example embodiment, the blade carrier is configured to secure a blade to the cutter apparatus such that a cutting edge of the blade faces a bottom side of the housing, and the three engaging portions extend from a top side, a left side, and a right side of the housing. In an example embodiment, the housing and the blade carrier are shaped such that a cutting force applied to the housing when the blade carrier is in an extended position causes a top edge of the blade carrier to come into contact with the housing to frictionally lock the blade carrier in the extended position until the cutting force is removed. In an example embodiment, the housing includes dual flange members which are snap fitted through a channel in the blade carrier. In an example embodiment, the cutter apparatus further includes means for biasing the blade carrier toward a retracted position away from a distal end of the housing. In an example embodiment, the means for biasing includes a spring configured to push the blade carrier toward the retracted position. In an example embodiment, one or more of the engaging portions include a gripping surface. In an example embodiment, the gripping surface includes ridges. In an example embodiment, the blade carrier includes blade installation instructions thereon. In an example embodiment, the instructions include an image of a blade shown correctly oriented for installation on the blade carrier. In an example embodiment, the housing includes an indented portion sized to receive spare blades. In an example embodiment, the housing includes two housing portions that are pivotally coupled together. In an example embodiment, the cutter apparatus further includes means for securing the two housing portions together. In an example embodiment, one of the two housing portions includes a threaded channel, and the means for securing includes a screw with a threaded surface complementary to the threaded channel, the screw including a head with a perimeter portion that can be rotated by a user of the cutting apparatus. In an example embodiment, the head is shaped as a wheel. In an example embodiment, the cutter apparatus further includes means for urging the two housing portions apart. In an example embodiment, the means for urging includes a spring.

In an example embodiment, a cutter apparatus includes a housing sized to be hand-held, the housing including a channel and openings adjacent to the channel at three different sides of the housing, and a blade carrier sized to fit within and slide along the channel, the blade carrier including three engaging portions that extend from the openings such that a force bearing upon any of the portions can cause the blade carrier to slide along the channel, the blade carrier including blade installation instructions thereon. In an example embodiment, the instructions include an image of a blade shown correctly oriented for installation on the blade carrier. In an example embodiment, the housing is made at least in part from a plastic. In an example embodiment, the plastic includes acrylonitrile butadiene styrene (ABS). In an example embodiment, the blade carrier is configured to secure a blade to the cutter apparatus such that a cutting edge of the blade faces a bottom side of the housing, and the housing includes a metal skid plate which is secured to a bottom side of the housing defining a portion of an opening that faces the blade when the blade carrier is in an extended position. In an example embodiment, the blade carrier is configured to secure a blade to the cutter apparatus such that a cutting edge of the blade faces a bottom side of the housing, and the three engaging portions extend from a top side, a left side, and a right side of the housing. In an example embodiment, the housing and the blade carrier are shaped such that a cutting force applied to the housing when the blade carrier is in an extended position causes a top edge of the blade carrier to come into contact with the housing to frictionally lock the blade carrier in the extended position until the cutting force is removed. In an example embodiment, the housing includes dual flange members which are snap fitted through a channel in the blade carrier. In an example embodiment, the cutter apparatus further includes means for biasing the blade carrier toward a retracted position away from a distal end of the housing. In an example embodiment, the means for biasing includes a spring configured to push the blade carrier toward the retracted position. In an example embodiment, one or more of the engaging portions include a gripping surface. In an example embodiment, the gripping surface includes ridges. In an example embodiment, the housing includes recessed outer surface portions within which the openings are formed. In an example embodiment, the recessed outer surface portions extend longitudinally along the housing. In an example embodiment, one or more of the engaging portions includes a top surface that is substantially flush with an outer surface of the housing adjacent to the recessed outer surface portion. In an example embodiment, the one or more of the engaging portions are two engaging portions that extend from a left side and a right side of the housing, respectively. In an example embodiment, the housing includes an indented portion sized to receive spare blades. In an example embodiment, the housing includes two housing portions that are pivotally coupled together. In an example embodiment, the cutter apparatus further includes means for securing the two housing portions together. In an example embodiment, one of the two housing portions includes a threaded channel, and the means for securing includes a screw with a threaded surface complementary to the threaded channel, the screw including a head with a perimeter portion that can be rotated by a user of the cutting apparatus. In an example embodiment, the head is shaped as a wheel. In an example embodiment, the cutter apparatus further includes means for urging the two housing portions apart. In an example embodiment, the means for urging includes a spring.

In an example embodiment, a cutter system includes a cutter that includes a housing with two recessed portions on opposite sides thereof, the cutter being adapted to support a blade and to facilitate selectively extending the blade from or retracting the blade into the housing, and a holster shaped to receive the cutter in two different orientations corresponding to left- and right-handed use, respectively, the holster including an interior surface formed with protrusions on opposites sides thereof, the protrusions each being sized to fit into either of the recessed portions. In an example embodiment, one of the two recessed portions is the head of a fastener adapted to be secured to the housing. In an example embodiment, the housing includes two housing portions, and the fastener is adapted to secure the two housing portions together. In an example embodiment, the head is shaped as a wheel. In an example embodiment, the holster includes a flexible portion on which one of the protrusions is located. In an example embodiment, the holster includes a clip device. In an example embodiment, the clip device is adapted to attach the holster to a belt. In an example embodiment, the holster includes a back portion to which the clip device is mechanically coupled. In an example embodiment, the clip device is pivotally secured to the back portion. In an example embodiment, the back portion is integrally formed with a portion of the holster that includes the interior surface. In an example embodiment, the housing is made at least in part from a plastic. In an example embodiment, the plastic includes acrylonitrile butadiene styrene (ABS). In an example embodiment, the housing includes a channel and openings adjacent to the channel at three different sides of the housing, and the housing includes a blade carrier sized to fit within and slide along the channel, the blade carrier including three engaging portions that extend from the openings such that a force bearing upon any of the portions can cause the blade carrier to slide along the channel. In an example embodiment, the blade carrier is configured to secure the blade to the cutter such that a cutting edge of the blade faces a bottom side of the housing, and the housing includes a metal skid plate which is secured to a bottom side of the housing defining a portion of an opening that faces the blade when the blade carrier is in an extended position. In an example embodiment, the blade carrier is configured to secure the blade to the cutter such that a cutting edge of the blade faces a bottom side of the housing, and the three engaging portions extend from a top side, a left side, and a right side of the housing. In an example embodiment, the housing and the blade carrier are shaped such that a cutting force applied to the housing when the blade carrier is in an extended position causes a top edge of the blade carrier to come into contact with the housing to frictionally lock the blade carrier in the extended position until the cutting force is removed. In an example embodiment, the housing includes dual flange members which are snap fitted through a channel in the blade carrier. In an example embodiment, the cutter includes means for biasing the blade carrier toward a retracted position away from a distal end of the housing. In an example embodiment, the means for biasing includes a spring configured to push the blade carrier toward the retracted position. In an example embodiment, one or more of the engaging portions include a gripping surface. In an example embodiment, the gripping surface includes ridges. In an example embodiment, the housing includes recessed outer surface portions within which the openings are formed. In an example embodiment, the recessed outer surface portions extend longitudinally along the housing. In an example embodiment, one or more of the engaging portions includes a top surface that is substantially flush with an outer surface of the housing adjacent to the recessed outer surface portion. In an example embodiment, the one or more of the engaging portions are two engaging portions that extend from a left side and a right side of the housing, respectively. In an example embodiment, the blade carrier includes blade installation instructions thereon. In an example embodiment, the instructions include an image of a blade shown correctly oriented for installation on the blade carrier. In an example embodiment, the housing includes an indented portion sized to receive spare blades. In an example embodiment, the housing includes two housing portions that are pivotally coupled together. In an example embodiment, the cutter further includes means for urging the two housing portions apart. In an example embodiment, the means for urging includes a spring.

DISCLOSURE OF INVENTION

Figure 7A:
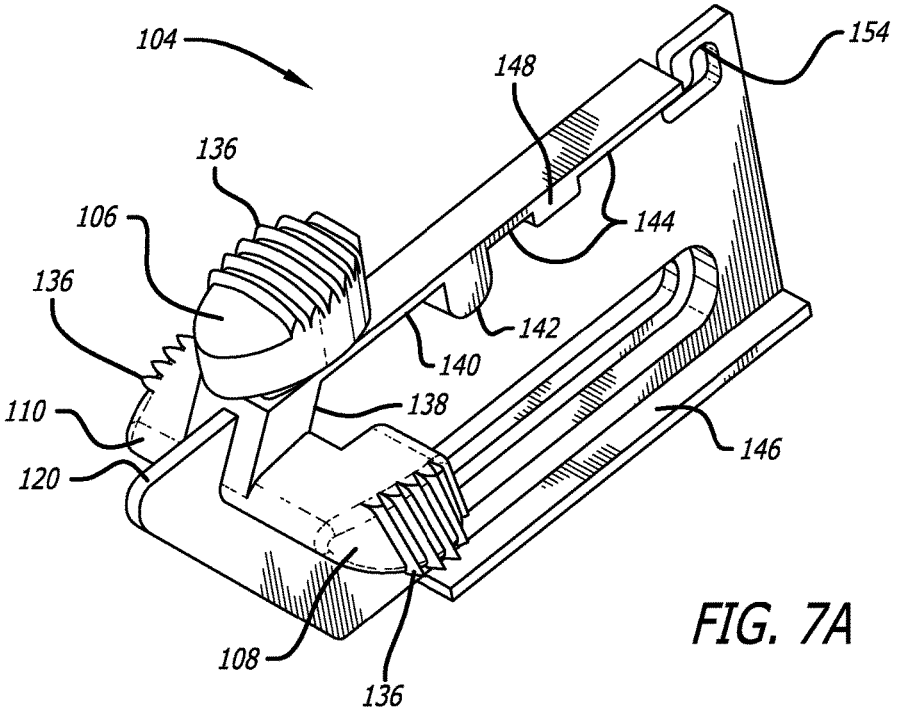
FIGS. 7A and 7B are perspective and side views, respectively, of a blade carrier of the safety cutter of FIG. 1.
Figure 7B:
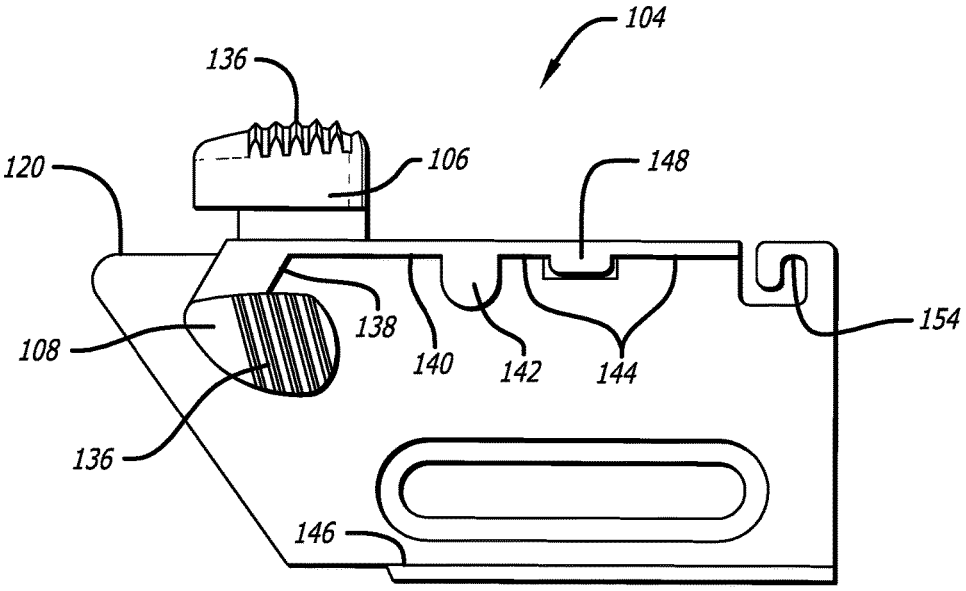
Figure 8:
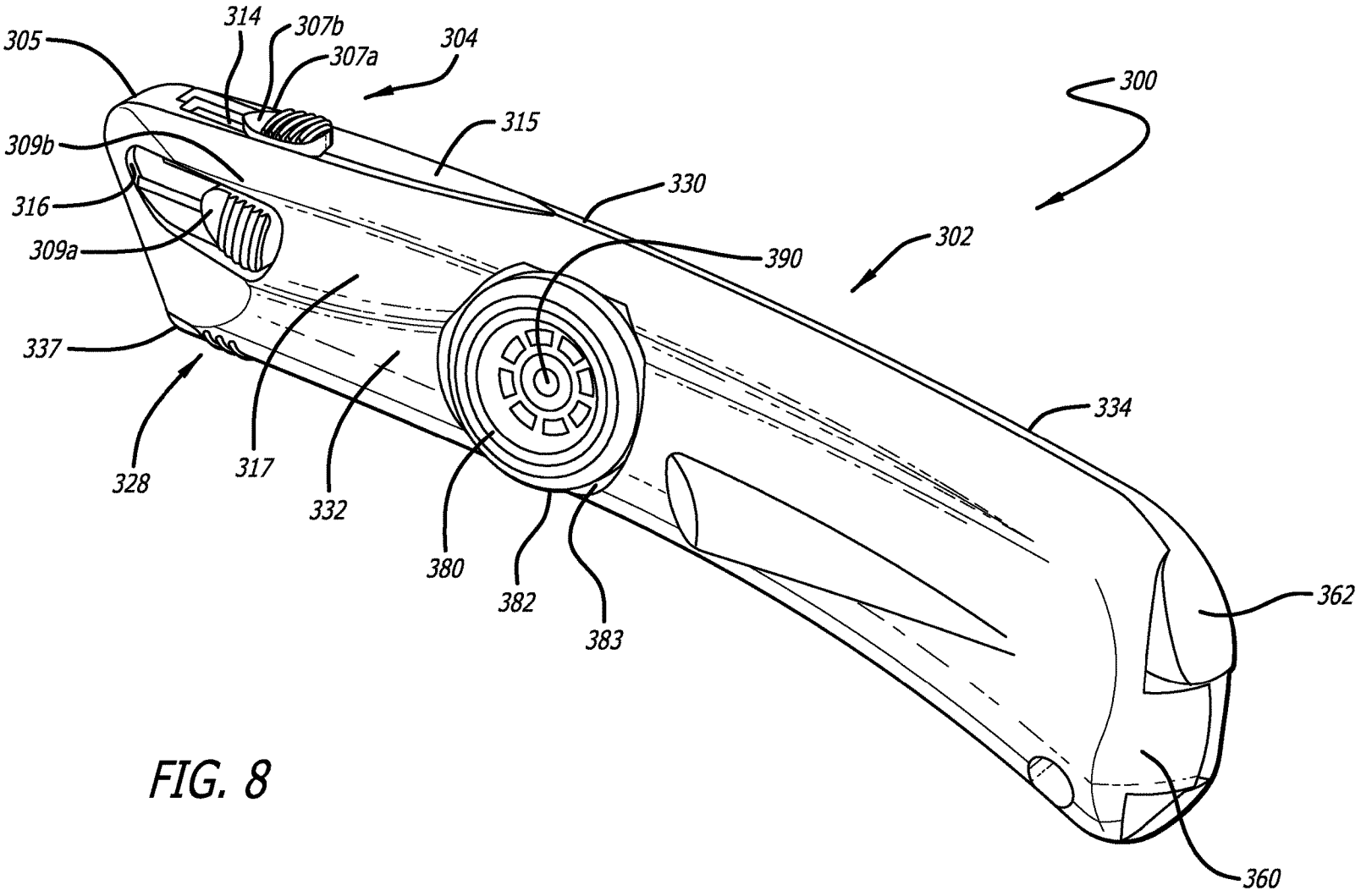
FIG. 8 is a perspective view of another example embodiment of a safety cutter.
Figure 9:
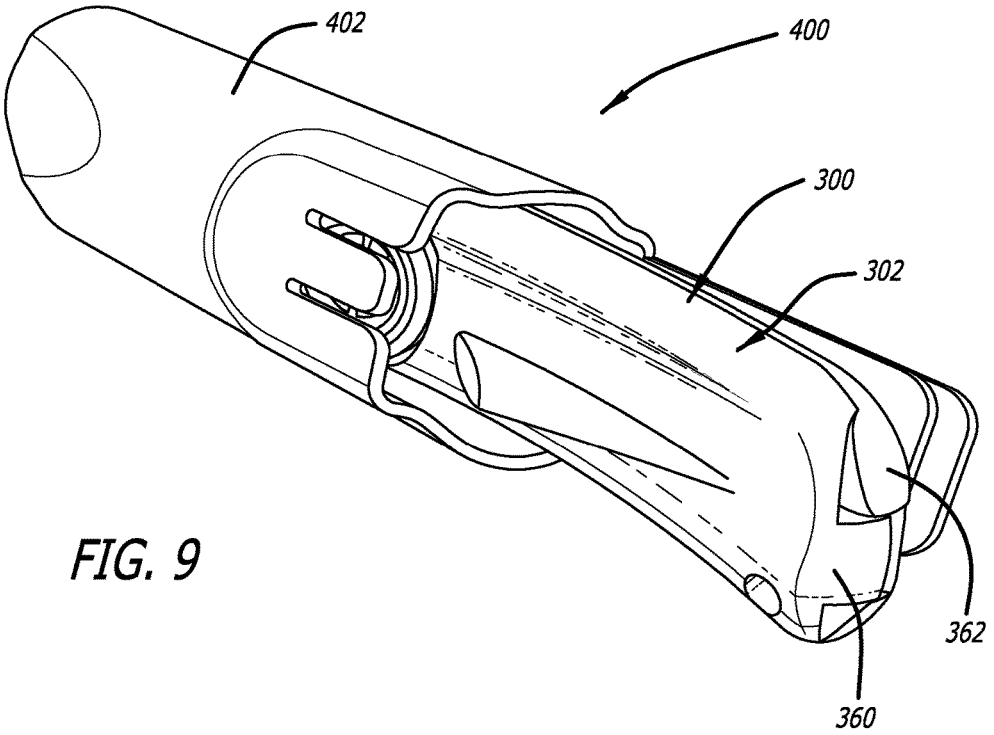
FIG. 9 is a perspective view of the safety cutter of FIG. 8 shown operatively engaged with another example embodiment of a holster.
Figure 10:
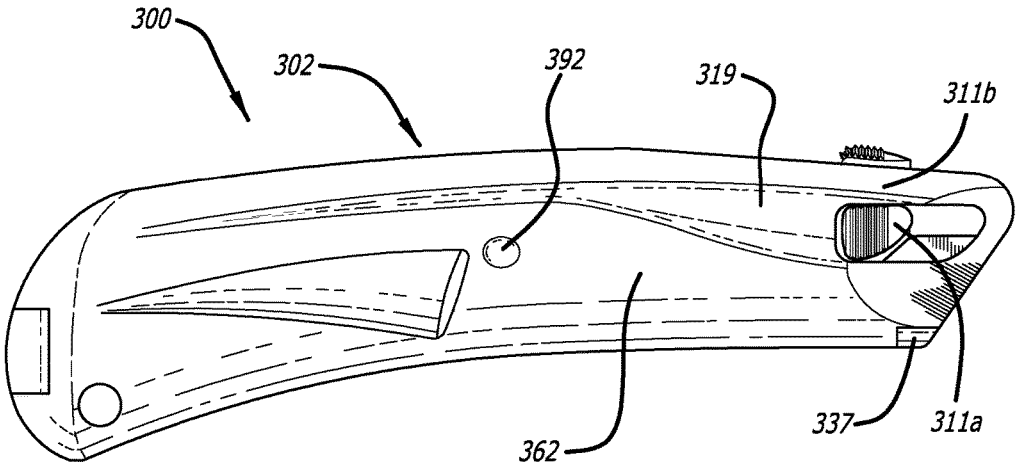
FIG. 10 is a back view of the safety cutter of FIG. 8.
Figure 11C:
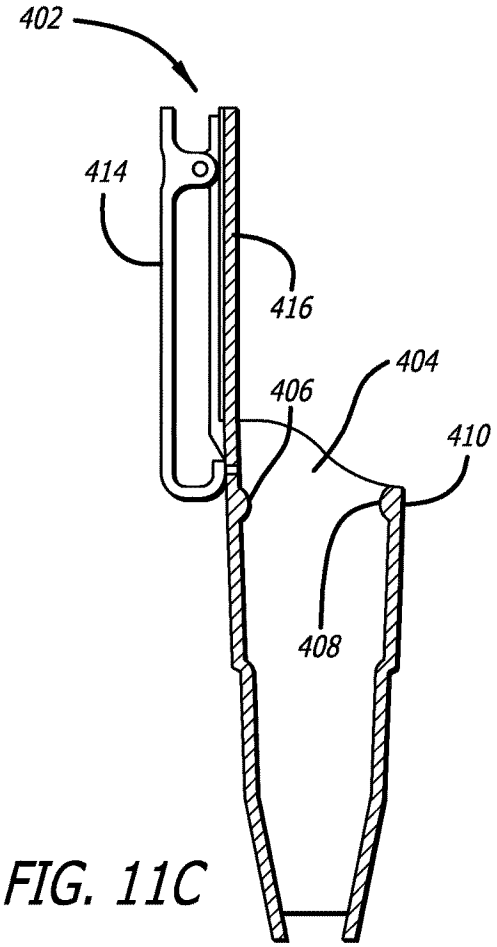
FIG. 11C shows a partial cross-section of the holster side view of FIG. 11B.
Figure 11B:
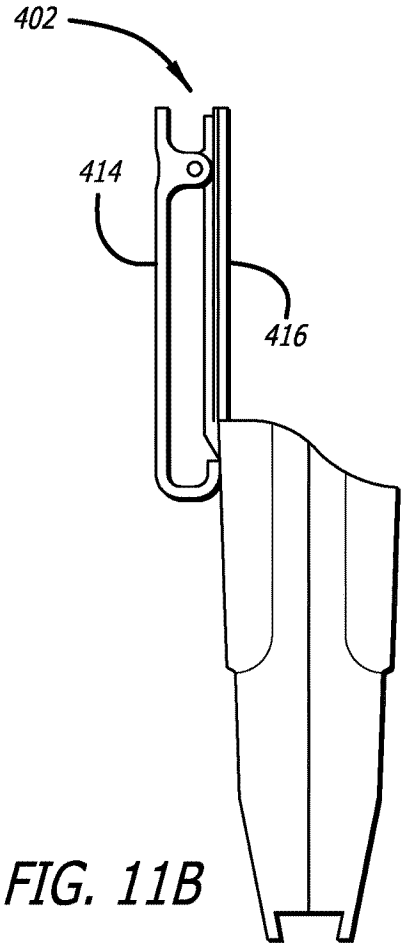
FIGS. 11A and 11B are front and side views, respectively, of the holster of FIG. 9.
Figure 11A:
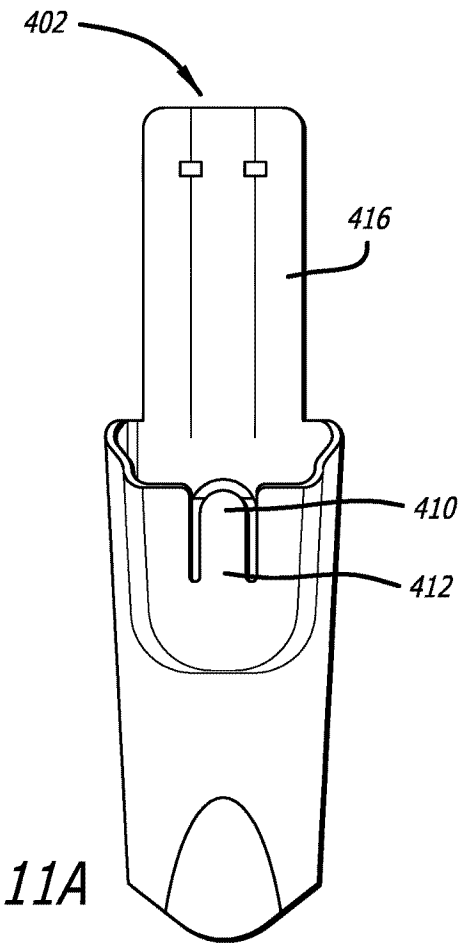

Referring to FIGS. 1, 4, 5, 6A and 6B, an example cutter apparatus 100 includes a housing 102, a blade carrier 104, and a mechanism for biasing the blade carrier 104 toward a retracted position away from a distal end 105 of the housing. In this example embodiment, and referring also to FIGS. 7A and 7B, the blade carrier 104 is a "triple locking slider" which includes a top engaging portion 106, a left engaging portion 108, and a right engaging portion 110 formed as shown. The housing 102 includes a channel 112 and openings 114, 116 and 118 which are adjacent to the channel 112. In an example embodiment, the openings 114, 116 and 118 are approximately equidistant from the distal end 105 of the housing. The blade carrier 104 is sized to fit within and slide along the channel 112 with its top, left and right engaging portions 106, 108 and 110 extending from the openings 114, 116 and 118, respectively. In this example embodiment, the housing 102 and the blade carrier 104 are shaped such that a cutting force (represented by arrow 119) applied to the housing when the blade carrier is in an extended position causes a top edge 120 of the blade carrier to come into contact with the housing frictionally locking the blade carrier in the extended position until the cutting force is removed. More specifically, when a counterforce (represented by arrow 121) is applied to a blade which is secured to the blade carrier 104, the top edge 120 of the blade carrier is forced against the housing. Adjacent to the distal end 105 of the housing 102, a portion 122 of the channel 112 is complementary in shape to the top edge 120 of the blade carrier 104, which facilitates the friction locking described above.

In an example embodiment, a cutter apparatus includes a housing (e.g., sized to be hand-held) and a blade carrier. The housing includes a channel and openings adjacent to the channel at three different sides of the housing. The blade carrier is sized to fit within and slide along the channel, and includes three engaging portions that extend from the openings such that a force bearing upon any of the portions can cause the blade carrier to slide along the channel.

In the example embodiment described herein, the blade carrier 104 is configured to secure a blade 124 to the cutter apparatus 100 such that a cutting edge 126 of the blade faces a bottom side 128 of the housing, and the three engaging portions 106, 108 and 110 extend from a top side 130, a left side 132, and a right side 134 of the housing, respectively. One or more of the engaging portions 106, 108 and 110 can include a gripping surface (e.g., ridges) 136.

The blade carrier 104 can include one or more surfaces that are complementary to the blade 124. In the example embodiment described herein, the blade carrier 104 includes complementary surfaces 138, 140, 142, 144 and 146 which are formed as shown for preventing the blade 124 from sliding over the blade carrier. In this example embodiment, the blade carrier 104 also includes a tab member 148 under which the blade 124 is fitted. The tab member 148, in conjunction with rails 150 and 152 of the housing 102, prevents the blade 124 from falling away from the blade carrier 104 when the housing is assembled. In this example embodiment, the blade carrier 104 also includes a detent 154, and the mechanism for biasing the blade carrier 104 is a spring 156 which mechanically couples the blade carrier (at the detent 154) to a back portion 158 (e.g., a post) of the housing.

In an example embodiment, the housing 102 includes two housing portions 160 and 162 that are pivotally coupled together. By way of example, the housing portions 160 and 162 are formed with complementary end portions through which a pin 164 is inserted to effect a pivotal interconnection. In this example embodiment, the housing portion 162 includes an indented portion 166 sized to receive spare blades 168, and the housing portion 160 is provided with a spring 170 which is compressed between the housing portion 160 and an edge 172 of the indented portion 166.

The cutter apparatus 100 further includes a mechanism for securing the housing portions 160 and 162 together. In this example embodiment, the housing portion 162 includes a threaded channel 174, and the mechanism for securing includes a screw 176 with a threaded surface 178 complementary to the threaded channel 174. By way of example, the screw 176 includes a head 180 with a perimeter portion 182 that can be rotated by a user of the cutting apparatus, but which is also inset within a recess 183 formed in the housing portion 160. Thus, in this example, the screw 176 is fitted through an opening 184 in the housing portion 160 and rotated into the threaded channel 174 to secure the housing portions 160 and 162 together. When the screw 176 is loosened and removed, a force exerted by the spring 170 pushes the housing portions 160 and 162 apart slightly to make it easier for a user to pry open the cutter apparatus 100 (e.g., to replace a blade on the blade carrier 104). In this example embodiment, the threaded surface 178 is formed within a post member 186, which also serves as a stop for the blade carrier 104 when the blade carrier is pulled by the spring 156 to its retracted position. In this example embodiment, the housing portions 160 and 162 also include ridges outer surface portions 188.

In this example embodiment, the perimeter portion 182 of the screw 176 is shaped (with ridges) for gripping the screw. The head 180 of the screw 176 can be shaped to include an ornamental design. In this example embodiment, the design is that of a tire on a rim. It should be appreciated, however, that other designs and appearances for the securing mechanism can be used.

In an example embodiment, a cutter apparatus includes a housing with two hand-grip portions that are shaped to be interfitted together, and a blade carrier. The housing includes a channel and openings facing the channel at three different locations around the housing. The blade carrier is sized to fit within and slide along the channel, and includes three engaging portions that extend from the openings such that a sufficient force bearing upon any of the three engaging portions causes the blade carrier to slide along the channel.

In another example embodiment, a cutter apparatus includes a housing with two separable handle portions that define a channel within the housing, and a blade carrier. The housing includes openings facing the channel at top, left and right sides of the housing. The blade carrier is sized to fit within and slide along the channel, and includes three engaging portions that extend from the openings such that a sufficient force bearing upon any of the three engaging portions causes the blade carrier to slide along the channel.

Figure 1:
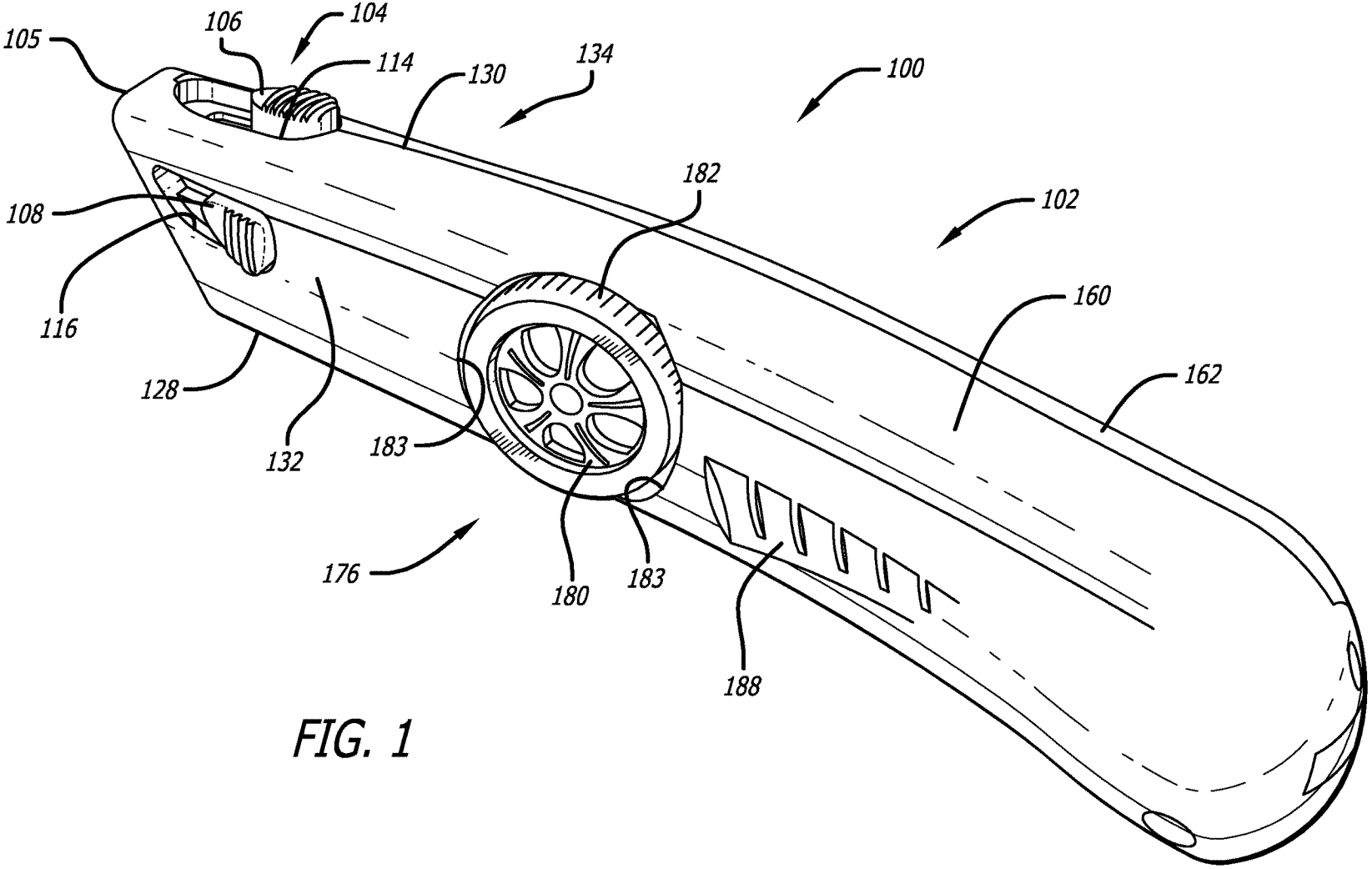
FIG. 1 is a perspective view of an example safety cutter with a triple locking slider mechanism.
Figure 2:
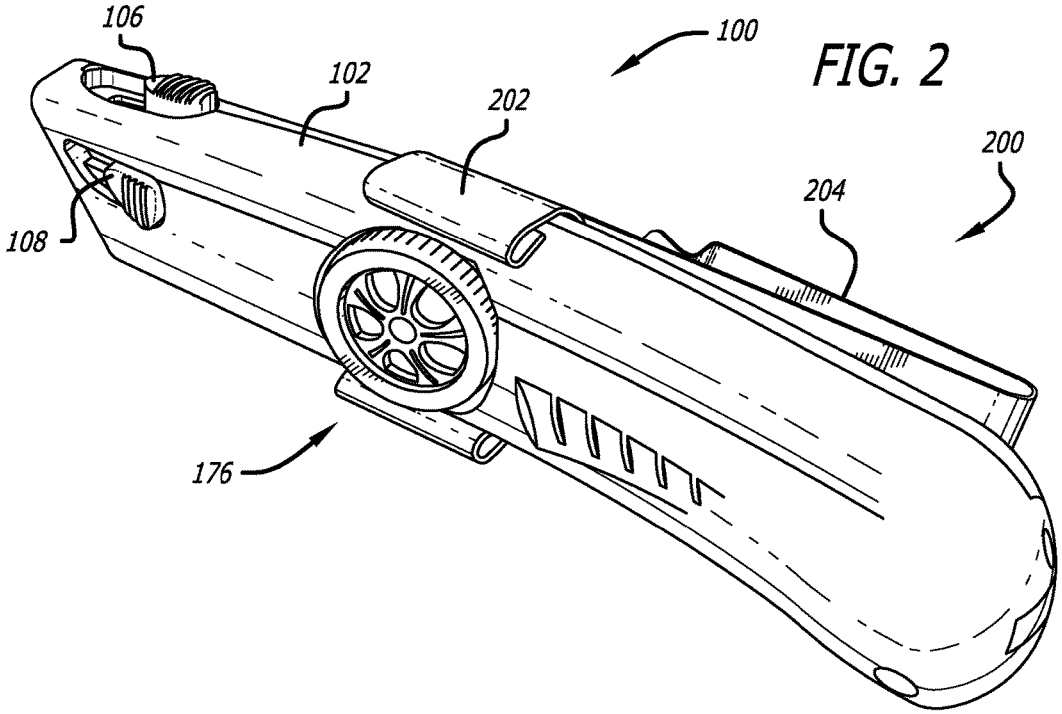
FIG. 2 is a perspective view of the safety cutter of FIG. 1 shown operatively engaged with a clip holster.
Figure 3A:
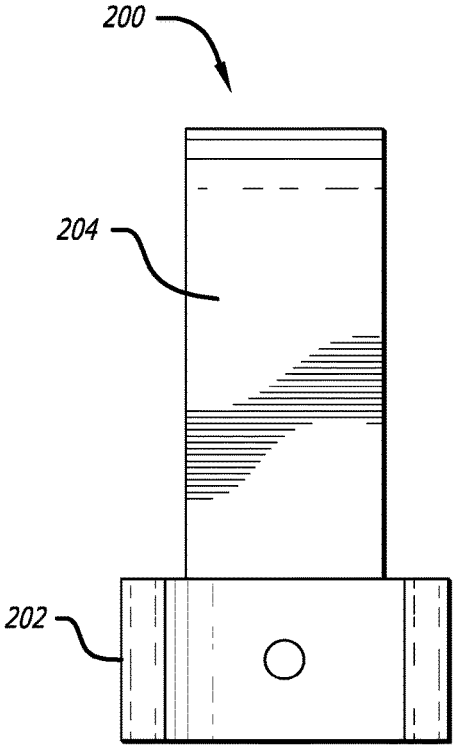
FIGS. 3A and 3B are front and side views, respectively, of the clip holster of FIG. 2.
Figure 3B:
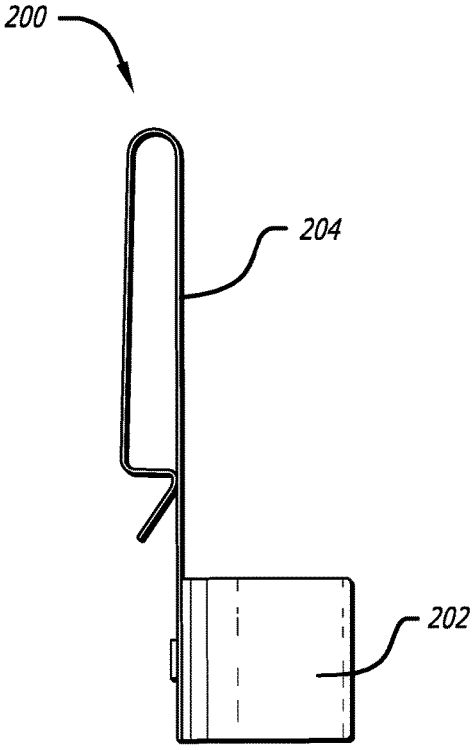
Figure 4:
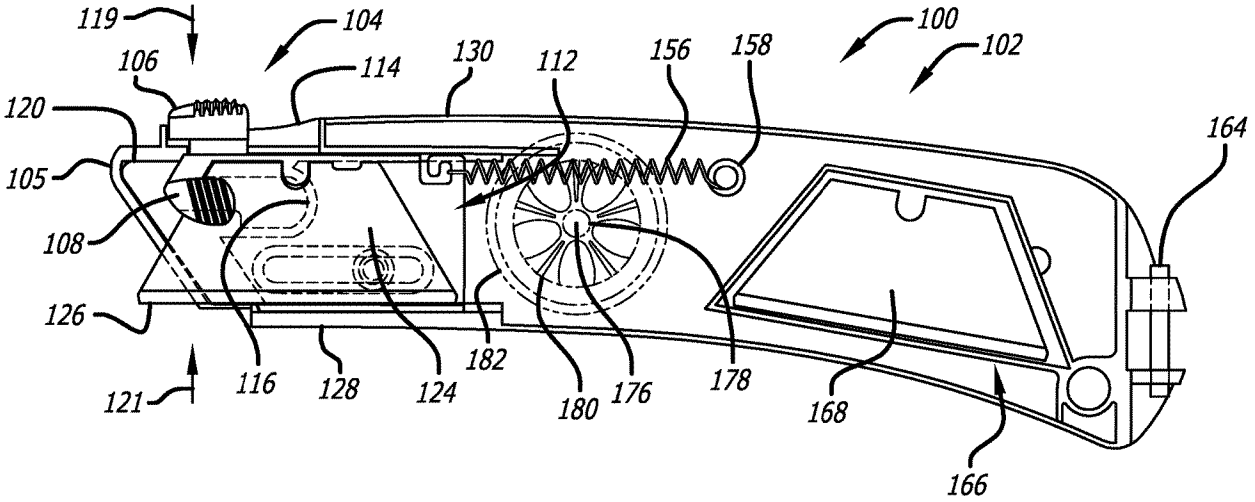
FIGS. 4 and 5 are cross-sectional side views of the safety cutter of FIG. 1 shown in a blade forward position and in a blade retracted position, respectively.
Figure 5:
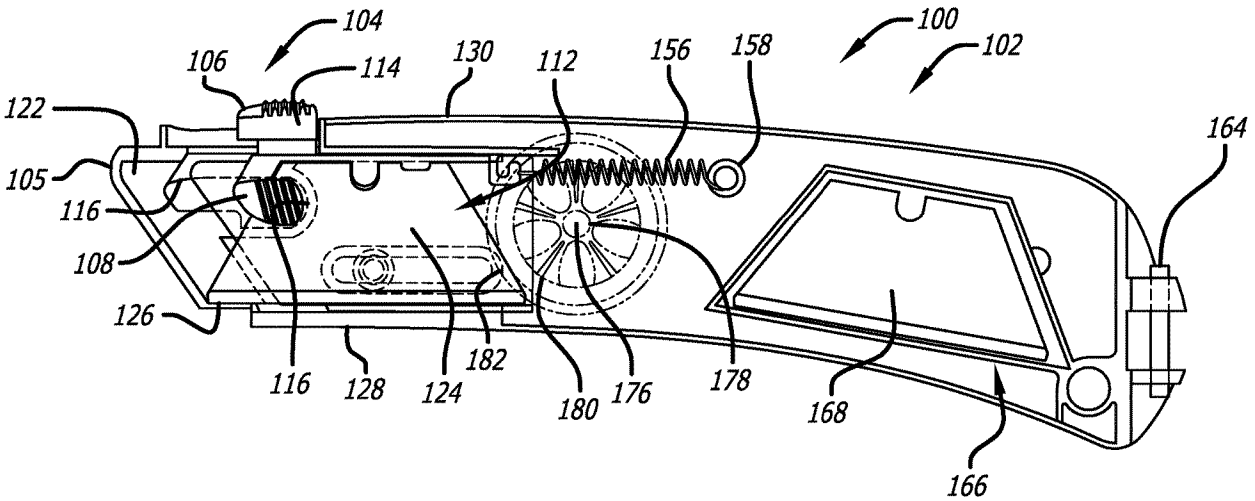
Figure 6A:
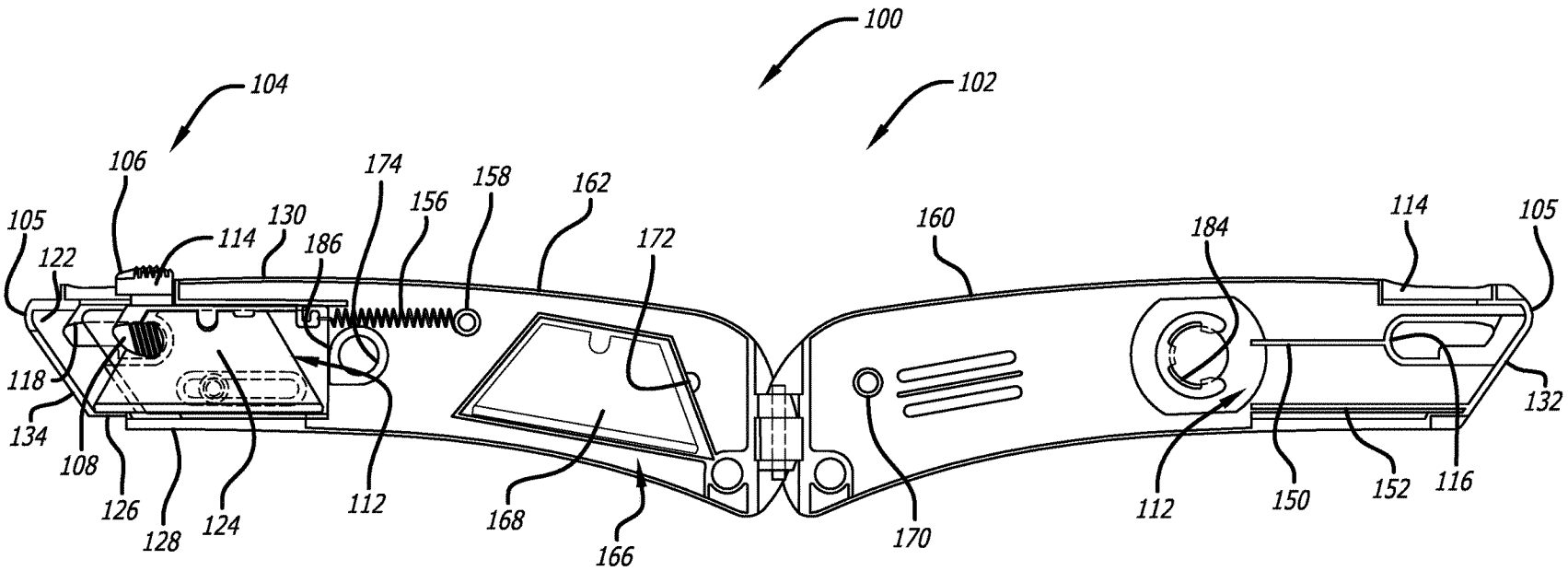
FIGS. 6A and 6B are front and perspective views, respectively, of the safety cutter of FIG. 1 shown in an opened position.
Figure 6B:
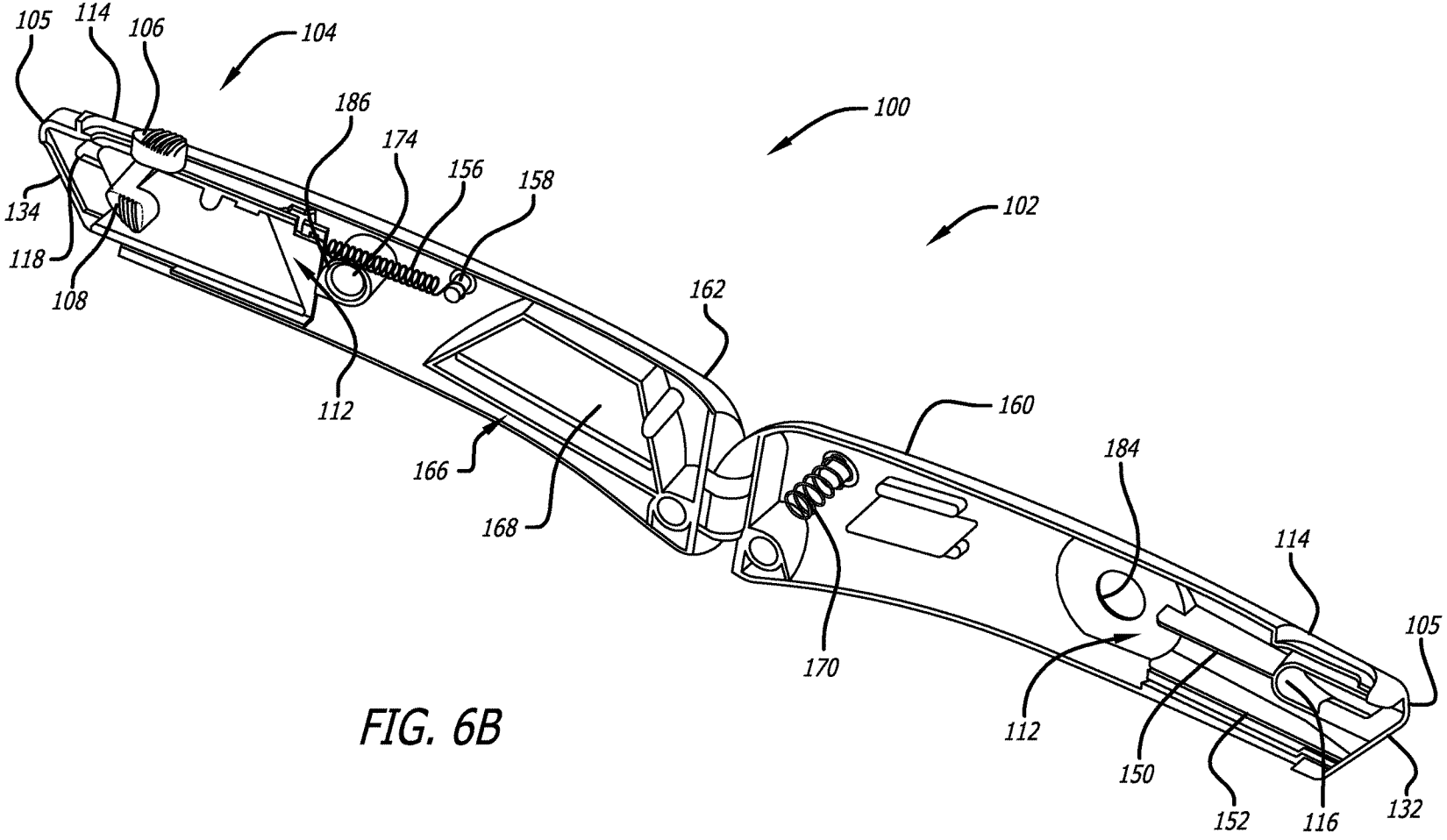

Referring to FIGS. 2, 3A and 3B, in various embodiments, the cutter apparatus 100 further includes a clip holster 200 sized to receive the housing 102 therein. In this example embodiment, a flexible clamp 202 (e.g., made of metal) is sized and configured to "snap fit" about the housing 102. In this example embodiment, the clip holster 200 also includes a clip member 204 which is secured (e.g., riveted) to the flexible clamp 202. In this example embodiment, the clip member 204 is sized for securing to a belt or similar object.

The housing 102 and other example housings described herein can be made from metal (e.g., aluminum, steel, brass), plastic (e.g., acrylonitrile butadiene styrene (ABS)), or other materials, or from a combination of materials. In an example embodiment, a cutter apparatus includes a housing sized to be hand-held, the housing being made at least in part from a plastic, the housing including a channel and openings adjacent to the channel at three different sides of the housing, and a blade carrier sized to fit within and slide along the channel, the blade carrier including three engaging portions that extend from the openings such that a force bearing upon any of the portions can cause the blade carrier to slide along the channel.

Figure 15A:
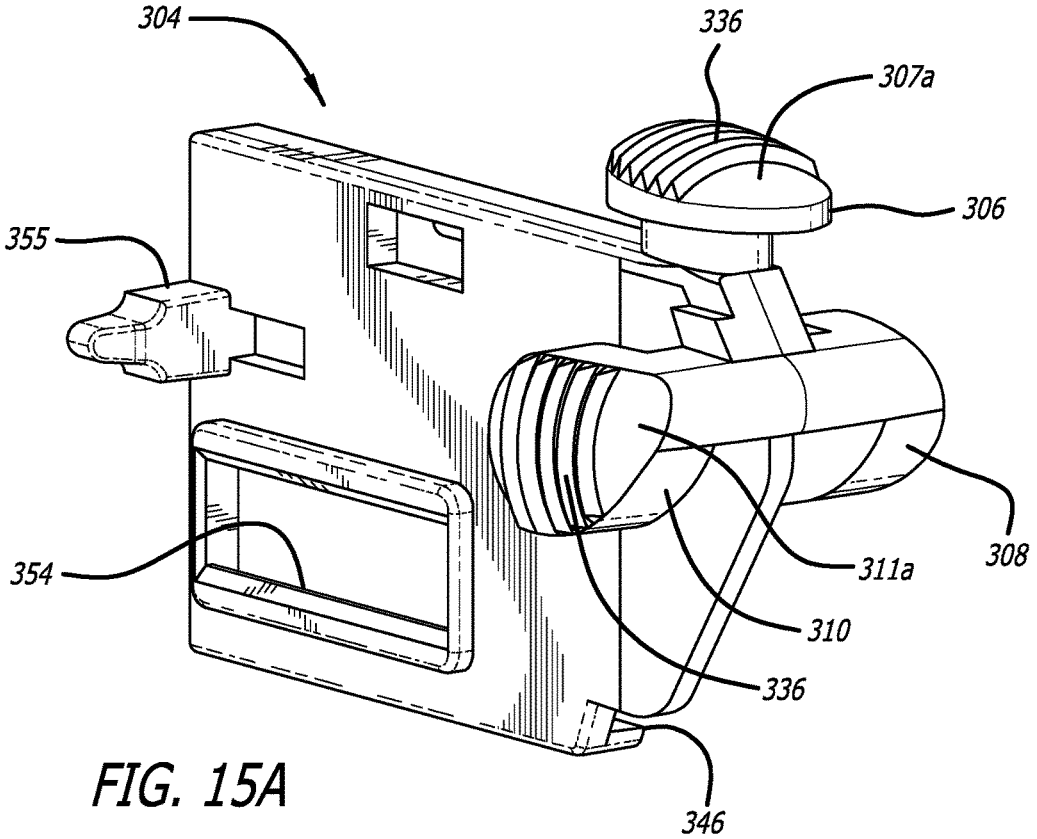
FIGS. 15A and 15B are perspective and side views, respectively, of a blade carrier of the safety cutter of FIG. 8.
Figure 15B:
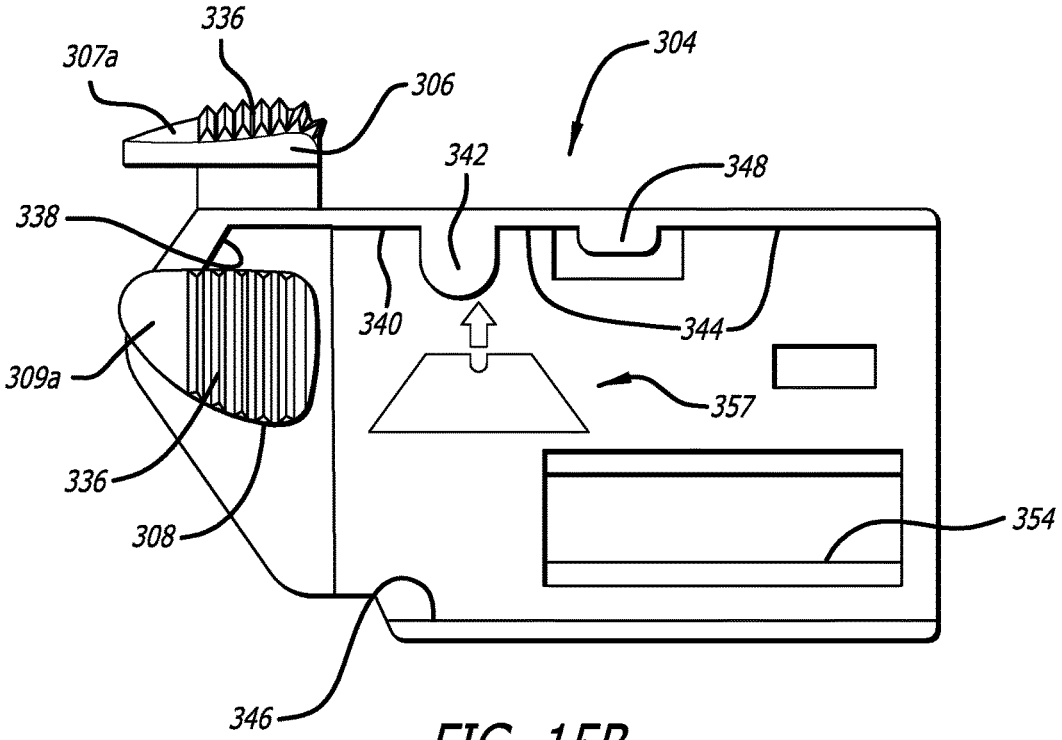

Referring to FIGS. 8, 10, 12, 13, 14A and 14B, an example cutter apparatus 300 includes a housing 302, a blade carrier 304, and a mechanism for biasing the blade carrier 304 toward a retracted position away from a distal end 305 of the housing. In this example embodiment, and referring also to FIGS. 15A and 15B, the blade carrier 304 is a "triple locking slider" which includes a top engaging portion 306, a left engaging portion 308, and a right engaging portion 310 formed as shown. The housing 302 includes a channel 312 and openings 314, 316 and 318 which are adjacent to the channel 312. In an example embodiment, the openings 314, 316 and 318 are approximately equidistant from the distal end 305 of the housing. The blade carrier 304 is sized to fit within and slide along the channel 312 with its top, left and right engaging portions 306, 308 and 310 extending from the openings 314, 316 and 318, respectively. In this example embodiment, the blade carrier 304 does not include the top edge 120 (of blade carrier 104) for frictional locking of the blade carrier in an extended position; however, it should be understood that the blade carrier 304 can be adapted as previously described or otherwise to facilitate frictional locking of the blade carrier 304 with the housing 302.

In this example embodiment, the blade carrier 304 is configured to secure a blade 324 (shown in dashed lines) to the cutter apparatus 300 such that a cutting edge 326 of the blade faces a bottom side 328 of the housing, and the three engaging portions 306, 308 and 310 extend from a top side 330, a left side 332, and a right side 334 of the housing, respectively. One or more of the engaging portions 306, 308 and 310 can include a gripping surface (e.g., ridges) 336. In this example embodiment, the housing 302 includes a metal skid plate 337 which is secured to a bottom side of the housing defining a portion of an opening 339 that faces the blade when the blade carrier 304 is in an extended position. In operation, the metal skid plate 337 can serve as a contact point between the cutter apparatus 300 and a work piece.

In this example embodiment, the housing 302 includes recessed outer surface portions 315, 317 and 319 within which the openings 314, 316 and 318, respectively, are formed. The recessed outer surface portions 315, 317 and 319 provide "indents" along the housing 302 behind the engaging portions 306, 308 and 310, respectively, making it easier for a thumb or finger to push the blade carrier 304 toward the distal end 305 of the housing 302. The recessed outer surface portions 315, 317 and 319 additionally facilitate streamlining the overall shape of the cutter apparatus 300 by allowing one or more of the engaging portions 306, 308 and 310 to be positioned deeper within the housing 302 while still being easily accessible. This provides the added benefit of "lower profile" engaging portions which may be less likely to be accidentally repositioned. In this example embodiment, the engaging portions 306, 308 and 310 include top surfaces 307*a*, 309*a* and 311*a*, respectively, that are substantially flush with outer surfaces 307*b*, 309*b* and 311*b*, respectively, of the housing 302. As shown in this example embodiment, the outer surfaces 307*b*, 309*b* and 311*b* are adjacent to the recessed outer surface portions 315, 317 and 319, respectively. In an example embodiment, engaging portions that extend from the left and right sides of the housing are substantially flush with the housing.

In an example embodiment, a cutter apparatus includes a housing sized to be hand-held, the housing including a channel and openings adjacent to the channel at three different sides of the housing, the housing includes recessed outer surface portions within which the openings are formed, and a blade carrier sized to fit within and slide along the channel, the blade carrier including three engaging portions that extend from the openings such that a force bearing upon any of the portions can cause the blade carrier to slide along the channel. In an example embodiment, the recessed outer surface portions extend longitudinally along the housing. In an example embodiment, one or more of the engaging portions includes a top surface that is substantially flush with an outer surface of the housing adjacent to the recessed outer surface portion. In an example embodiment, the one or more of the engaging portions are two engaging portions that extend from a left side and a right side of the housing, respectively.

Figure 12:
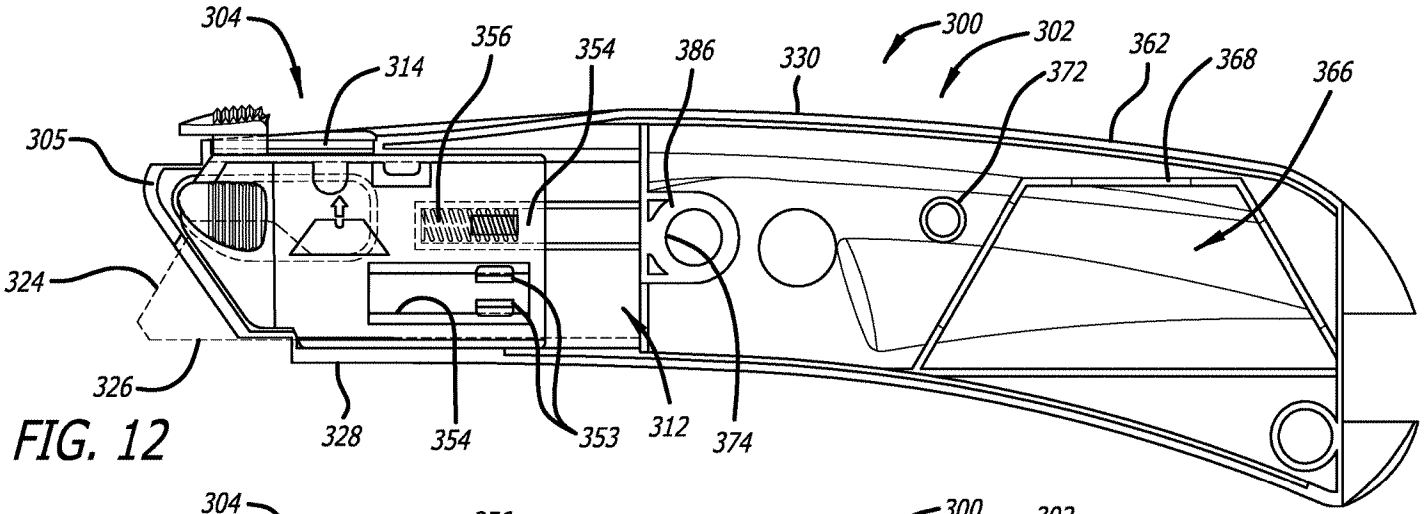
FIGS. 12 and 13 are cross-sectional side views of the safety cutter of FIG. 8 shown in a blade forward position and in a blade retracted position, respectively.
Figure 13:
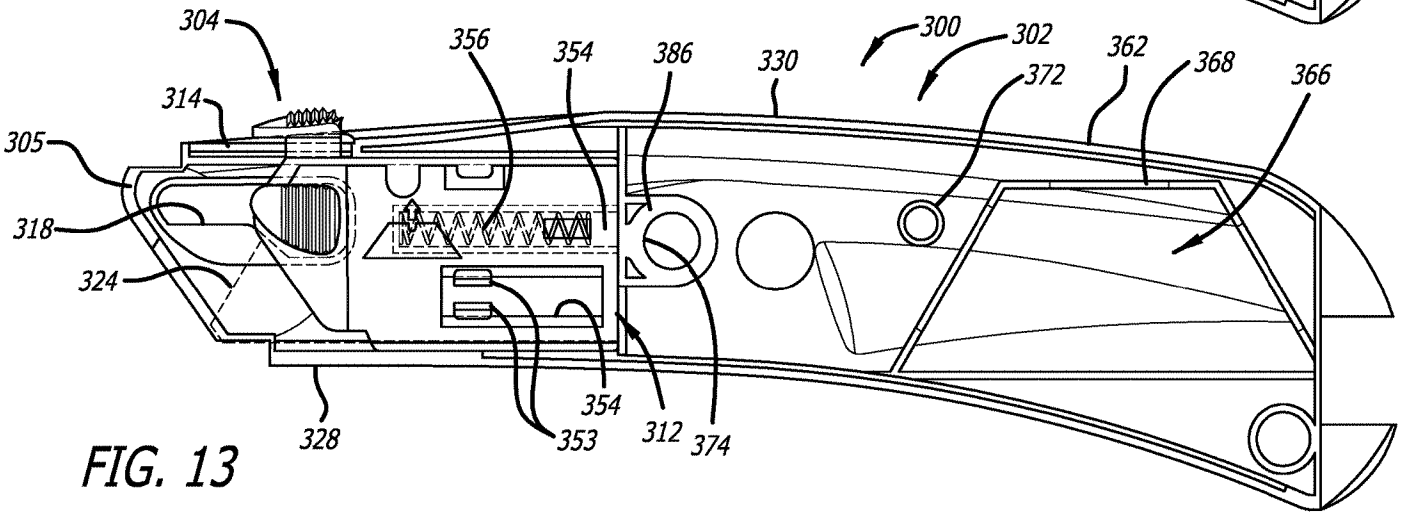
Figure 14A:
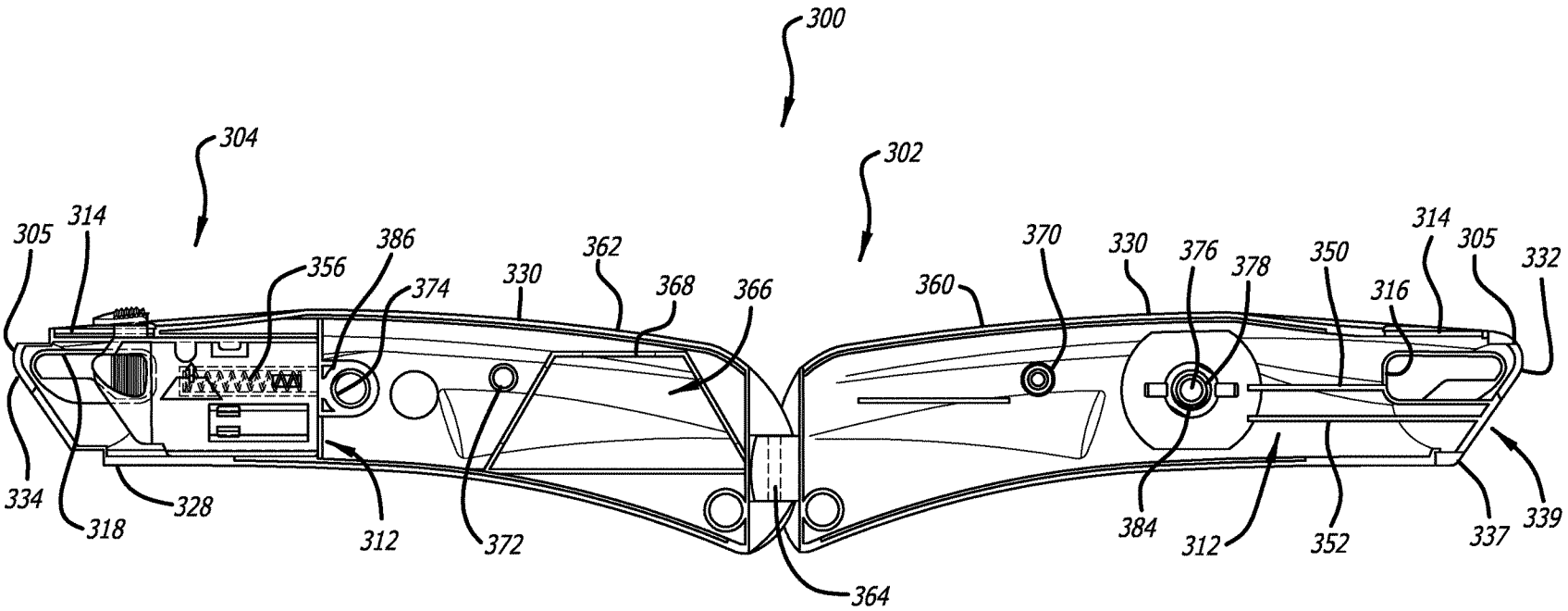
FIGS. 14A and 14B are front and exploded perspective views, respectively, of the safety cutter of FIG. 8 shown in an opened position.
Figure 14B:
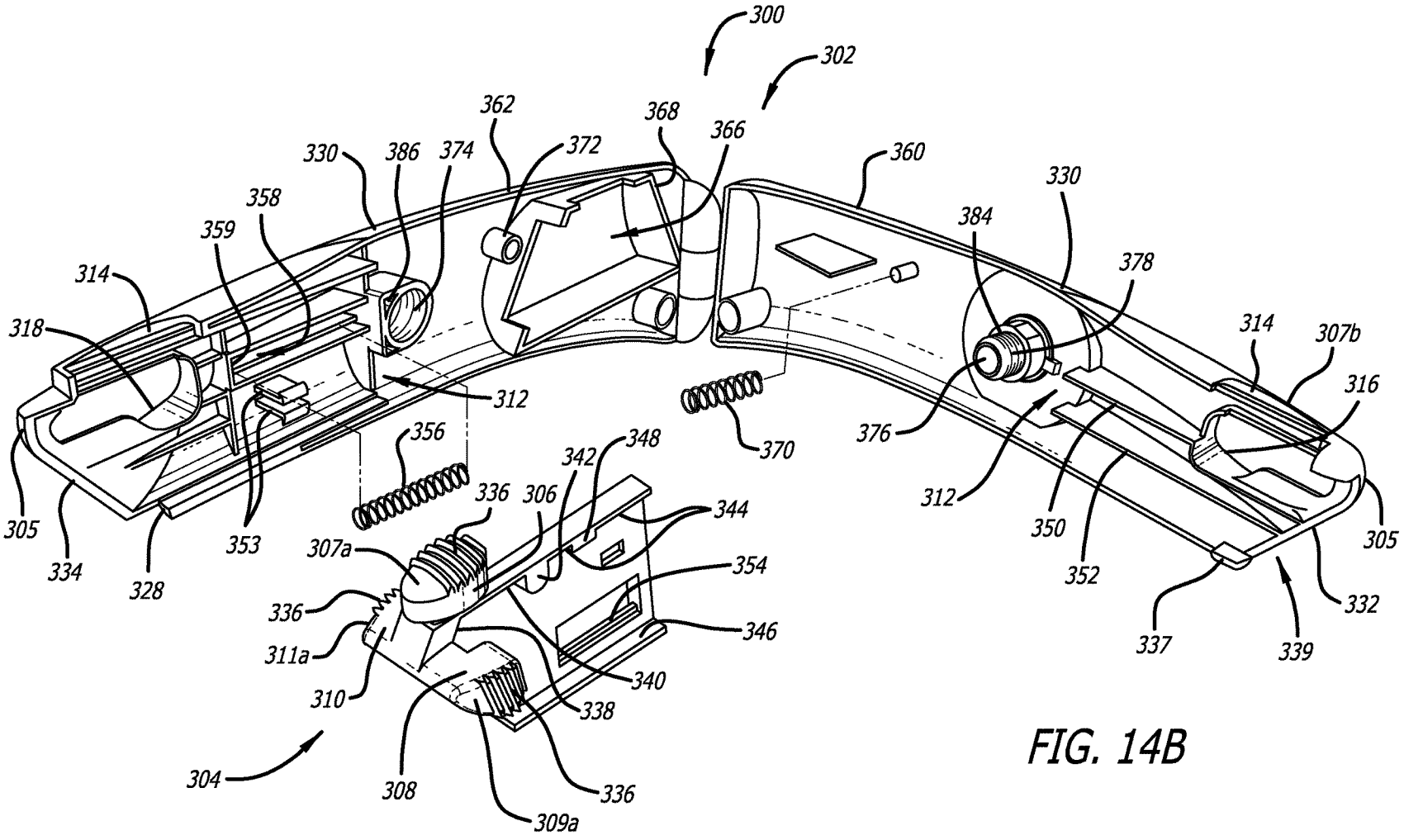

The blade carrier 304 can include one or more surfaces that are complementary to the blade 324. In this example embodiment, the blade carrier 304 includes complementary surfaces 338, 340, 342, 344 and 346 which are formed as shown for preventing the blade 324 from sliding over the blade carrier. In this example embodiment, the blade carrier 304 also includes a tab member 348 under which the blade 324 is fitted. The tab member 348, in conjunction with rails 350 and 352 of the housing 302, prevents the blade 324 from falling away from the blade carrier 304 when the housing is assembled. In this example embodiment, the housing 302 includes dual flange members 353 which are snap fitted through a channel 354 in the blade carrier 304. In this example embodiment, the blade carrier 304 also includes a guide member 355, and the mechanism for biasing the blade carrier 304 is a spring 356 configured to push the blade carrier 304 toward the retracted position (FIG. 13). In this example embodiment, the spring 356 is fitted into a receiving channel 358 of the housing 302 and is compressed between a surface 359 (at the end of the channel 358) and the guide member 155. As shown in FIG. 12, the spring 356 is more compressed when the blade carrier 304 is in its extended position. In this example embodiment, the blade carrier 304 also includes blade installation instructions 357 thereon. In this example embodiment, the instructions 357 include an image of a blade shown correctly oriented for installation on the blade carrier 304, with an arrow showing the correct direction to move the blade. It should be understood that the blade installation instructions 357 can also include text, or alternately, a combination of an image (or images) and text. The blade installation instructions 357 can include any form of visible and/or tactile indicia, for example, an embossed or raised surface, a decal, sticker, etc.

In an example embodiment, a cutter apparatus includes a housing sized to be hand-held, the housing including a channel and openings adjacent to the channel at three different sides of the housing, and a blade carrier sized to fit within and slide along the channel, the blade carrier including three engaging portions that extend from the openings such that a force bearing upon any of the portions can cause the blade carrier to slide along the channel, the blade carrier including blade installation instructions thereon.

In this example embodiment, the housing 302 includes two housing portions 360 and 362 that are pivotally coupled together. By way of example, the housing portions 360 and 362 are formed with complementary end portions through which a pin 364 is inserted to effect a pivotal interconnection. In this example embodiment, the housing portion 362 includes an indented portion 366 (defined by wall portions 368 as shown) sized to receive spare blades, and the housing portion 360 is provided with a spring 370 which is compressed between the housing portion 360 and a post 372 of the housing portion 362.

The cutter apparatus 300 further includes a mechanism for securing the housing portions 360 and 362 together. In this example embodiment, the housing portion 362 includes a threaded channel 374, and the mechanism for securing includes a screw 376 with a threaded surface 378 complementary to the threaded channel 374. By way of example, the screw 376 includes a head 380 with a perimeter portion 382 that can be rotated by a user of the cutting apparatus, but which is also inset within a recess 383 formed in the housing portion 360. Thus, in this example, the screw 376 is fitted through an opening 384 in the housing portion 360 and rotated into the threaded channel 374 to secure the housing portions 360 and 362 together. When the screw 376 is loosened and removed, a force exerted by the spring 370 pushes the housing portions 360 and 362 apart slightly to make it easier for a user to pry open the cutter apparatus 300 (e.g., to replace a blade on the blade carrier 304). In this example embodiment, the threaded surface 378 is formed within a post member 386, which also serves as a stop for the blade carrier 304 when the blade carrier is pushed by the spring 356 to its retracted position.

In this example embodiment, the perimeter portion 382 of the screw 376 can be shaped (e.g., with ridges) for gripping the screw. The head 380 of the screw 376 can be shaped to include an ornamental design. In this example embodiment, the design is that of a wheel. It should be appreciated, however, that other designs and appearances for the securing mechanism can be used.

In this example embodiment, the head 380 includes a recessed portion 390, and the housing portion 362 includes a recessed portion 392. The recessed portions 390 and 392 are provided on opposite sides of the cutter apparatus 300 and, as discussed below, facilitate use of the cutter apparatus 300 as part of a cutter system.

Referring to FIGS. 9 and 11A-11C, in various embodiments, a cutter system 400 includes the cutter apparatus 300 and a holster 402 shaped to receive the cutter in two different orientations corresponding to left- and right-handed use, respectively. In this example embodiment, the holster 402 includes an interior surface 404 formed with protrusions 406 and 408 on opposites sides thereof, the protrusions 406 and 408 each being sized to fit into either of the recessed portions 390 and 392. In an example embodiment, the holster 402 includes a flexible portion 410 on which one of the protrusions is located. In this example embodiment, the protrusion 408 is located on the flexible portion 410, and the flexible portion 410 flexes at a base 412 that joins the flexible portion 410 to the rest of the holster 402. Thus, the holster 402 is adapted to "snap fit" about the cutter apparatus 300 for either left- or right-handed use.

In this example embodiment, the holster 402 includes a clip device 414. As illustrated in this example embodiment, the clip device 414 is adapted to attach the holster 402 to a belt or a similar object. In this example embodiment, the clip device 414 is mechanically coupled (e.g., pivotally secured) to a back portion 416 of the holster 402. In an example embodiment, the back portion 416 is integrally formed with a portion of the holster 402 that includes the interior surface 404. In an example embodiment, the clip device 414 includes a spring (not shown) configured to bias the belt-receiving portion of the clip device toward the outside surface of the holster.

In an example embodiment, a cutter system includes a cutter that includes a housing with two recessed portions on opposite sides thereof, the cutter being adapted to support a blade and to facilitate selectively extending the blade from or retracting the blade into the housing, and a holster shaped to receive the cutter in two different orientations corresponding to left- and right-handed use, respectively, the holster including an interior surface formed with protrusions on opposites sides thereof, the protrusions each being sized to fit into either of the recessed portions.

Although the present invention has been described in terms of the example embodiments above, numerous modifications and/or additions to the above-described embodiments would be readily apparent to one skilled in the art. It is intended that the scope of the present invention extend to all such modifications and/or additions.

What is claimed is:

1. A cutter apparatus, comprising:

a housing sized to be hand-held, the housing including a channel and openings adjacent to the channel at three different sides of the housing; and a blade carrier sized to fit within and slide along the channel, the blade carrier including three engaging portions that extend from the openings such that a force bearing upon any of the portions can cause the blade carrier to slide along the channel, the blade carrier being repositionable from and in relation to a fully retracted position of the blade carrier, one of said engaging portions when the blade carrier is repositioned away from the fully retracted position during a blade replacement operation being engaged at the side opening of the housing through which said engaging portion extends preventing lateral movement of the blade carrier away from said side opening of the housing, and said side opening at a rear portion thereof being shaped such that said engaging portion is not engaged by said side opening when the blade carrier is in the fully retracted position.

2. The cutter apparatus of claim 1, wherein the blade carrier includes blade installation instructions thereon and the instructions include an image of a blade shown correctly oriented for installation on the blade carrier.

3. The cutter apparatus of claim 1, wherein the housing is made at least in part from a plastic.

4. The cutter apparatus of claim 1, wherein the blade carrier is configured to secure a blade to the cutter apparatus such that a cutting edge of the blade faces a bottom side of the housing, and the housing includes a metal skid plate which is secured to a bottom side of the housing defining a portion of an opening that faces the blade when the blade carrier is in an extended position.

5. The cutter apparatus of claim 1, wherein the housing and the blade carrier are shaped such that a cutting force applied to the housing when the blade carrier is in an extended position causes a top edge of the blade carrier to come into contact with the housing to frictionally lock the blade carrier in the extended position until the cutting force is removed.

6. The cutter apparatus of claim 1, wherein the housing includes dual flange members which are snap fitted through a channel in the blade carrier.

7. The cutter apparatus of claim 1, further comprising:

a spring configured to push the blade carrier toward a retracted position away from a distal end of the housing.

8. The cutter apparatus of claim 1, wherein at least one of the engaging portions includes a gripping surface.

9. The cutter apparatus of claim 8, wherein the gripping surface includes ridges.

10. The cutter apparatus of claim 1, wherein the housing includes recessed outer surface portions within which the openings are formed.

11. The cutter apparatus of claim 10, wherein the recessed outer surface portions extend longitudinally along the housing.

12. The cutter apparatus of claim 10, wherein at least one of the engaging portions includes a top surface that is substantially flush with an outer surface of the housing adjacent to one of the one or more recessed outer surface portions.

13. The cutter apparatus of claim 1, wherein the housing includes an indented portion sized to receive spare blades.

14. The cutter apparatus of claim 1, wherein the housing includes two housing portions that are pivotally coupled together.

15. The cutter apparatus of claim 14, wherein one of the two housing portions includes a threaded channel, and further including:

a screw configured for securing the two housing portions together, the screw having a threaded surface complementary to the threaded channel, the screw including a head with a perimeter portion that can be rotated by a user of the cutting apparatus.

16. The cutter apparatus of claim 15, wherein the head is shaped as a wheel.

17. The cutter apparatus of claim 14, further including:

a spring configured for urging the two housing portions apart.

* * * * *